United States Patent [19]

Hoffmann

[11] Patent Number: 4,618,394

[45] Date of Patent: Oct. 21, 1986

[54] ONE-SIDED CORRUGATED CARDBOARD MACHINE WITH SUCTION DEVICE

[75] Inventor: Martin Hoffmann, Tangstedt, Fed. Rep. of Germany

[73] Assignee: Werner H. K. Peters Maschinenfabrik GmbH, Hamburg, Fed. Rep. of Germany

[21] Appl. No.: 661,165

[22] Filed: Oct. 12, 1984

[30] Foreign Application Priority Data

Nov. 7, 1983 [DE] Fed. Rep. of Germany ... 8331823[U]

[51] Int. Cl.[4] ..... B31F 1/00; B31F 1/28

[52] U.S. Cl. ..... 156/473; 156/462; 156/210; 156/285; 156/582; 425/369; 425/388

[58] Field of Search ..... 156/205-210, 156/285, 470, 472, 473, 582, 462; 425/369, 388, 396; 264/286; 29/121.1, 121.5

[56] References Cited

U.S. PATENT DOCUMENTS

| | | | |
|---|---|---|---|
| Re. 31,138 | 2/1983 | Tokuno | 156/473 |
| 1,981,338 | 11/1934 | Swift | 156/473 |
| 4,251,313 | 2/1981 | Abe | 156/473 |
| 4,261,784 | 4/1981 | Saito | 156/473 X |
| 4,265,697 | 5/1981 | King | 156/473 |
| 4,348,250 | 9/1982 | Bromley | 156/473 |
| 4,381,212 | 4/1983 | Roberts | 156/473 |

*Primary Examiner*—Edward Kimlin
*Assistant Examiner*—Ramon R. Hoch
*Attorney, Agent, or Firm*—Harness, Dickey & Pierce

[57] ABSTRACT

A one-sided corrugated cardboard machine having an upper and a lower fluted roller, a pressure roller associated with the lower fluted roller, a suction box essentially extending the width of the lower fluted roller and connected to a vacuum source while being arranged on the side of the lower fluted roller which is not covered by the corrugated material web, said suction box creating a vacuum in annular suction grooves of the lower fluted roller, and sealing sheet metal members engaging within the suction grooves on the side of the suction box facing the pressure roller, with a supporting beam for the sealing sheet metal members retained in the machine stand which is arranged separately of the suction box, said suction box being adapted to be adjusted through a greater distance with the aid of an adjusting device.

8 Claims, 1 Drawing Figure

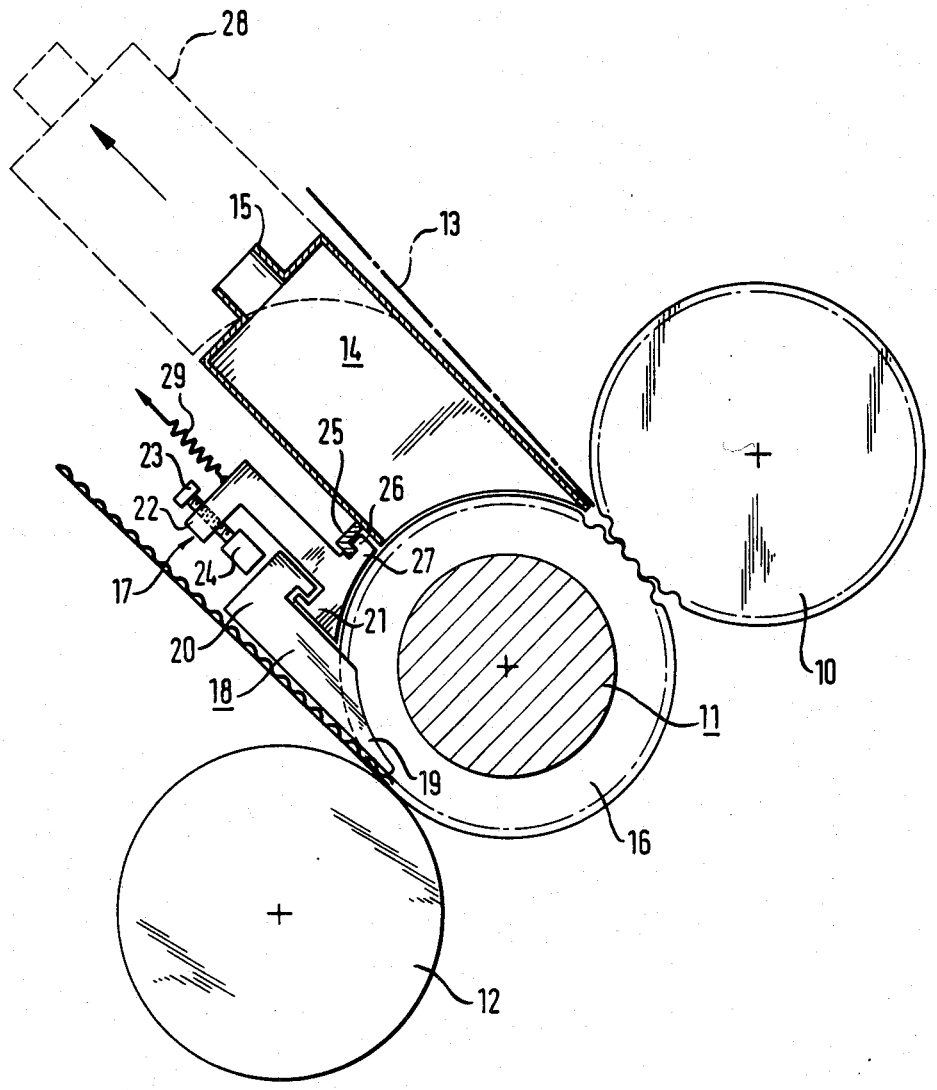
28
15
13
14
29
25
23
26
22
27
24
17
21
20
18
10
11
19
16
12

ONE-SIDED CORRUGATED CARDBOARD MACHINE WITH SUCTION DEVICE

The innovation relates to a one-sided corrugated cardboard machine comprising an upper and a lower fluted roller, a pressure roller associated with the lower fluted roller, a suction box extending over the width of the lower fluted roller and connected to a vacuum source while being arranged on that side of the lower fluted roller which is not covered by the web of corrugated cardboard and creating a vacuum in annular suction grooves of the lower fluted roller, and sealing sheet metal members engaging within the suction grooves on the side of the suction box facing the pressure roller.

Such a one-sided corrugated cardboard machine is known (German patent letter No. 2 840 150). The sealing sheet metal members are connected to the suction box on both sides and engage within the suction grooves. But such a construction suffers from a plurality of disadvantages.

The suction box or suction bonnet together with the sealing sheet metal members cover the entire associated circumferential region of the lower fluted roller. The latter is therefore completely inaccessible from outside.

A fluted roller is known to be subjected to changes in length due to thermal expansion. The sealing sheet metal members are as far as possible to follow these thermal expansions, otherwise the danger exists that they may slide along the groove walls and become distorted, respectively. It has, therefore, also become known to heat the suction box with steam so that it may follow the thermal expansions. Apart from the disadvantage of the additional expenditure therefor it has been found that in spite of the heating a sufficient adaptation to the thermal expansions of the fluted roller is still not obtained especially during the heating-up phase.

It is the object of the innovation in a one-sided corrugated cardboard machine comprising a suction box to design the latter in such a manner that perhaps in case of trouble access is afforded to the lower fluted roller and the gap between the suction box and the lower fluted roller, respectively.

This object is attained in accordance with the innovation in that a supporting beam is held in the machine stand for the sealing sheet metal members which is arranged separately of the suction box, and the suction box is adjustable with the aid of an adjusting device over a considerable distance.

With the corrugated cardboard machine according to the innovation the sealing sheet metal members are held by a supporting member which is held in the machine stand separately of the suction box. The suction box which covers a substantial portion of the circumference of the fluted roller may, therefore, be removed from the fluted roller far enough so as to conveniently afford access to the fluted roller.

The supporting beam for the sealing sheet metal members preferably is likewise adjustable but only through a limited distance such that the sealing sheet metal members will remain in the suction grooves. Such an adjustment is necessary, for instance, in order to prevent abutment in case of the so-called thermal strike (different radial expansion due to water of condensation).

In one embodiment of the innovation provision is made for the suction box to cooperate with the supporting beam via an abutment in such a manner that with an adjustment of the suction box in a direction towards the lower fluted roller the supporting beam will be carried along against the force of a spring and will be lifted from the lower fluted roller through a limited distance when the suction box is moved away from the lower fluted roller such that the sealing sheet metal members will still remain in the suction grooves. The movement of the supporting beam thus takes place between two abutments, with the first abutment being disposed in such a manner that the sealing sheet metal members are still seated in the suction grooves. The other abutment delimits the depth of the sealing sheet metal members in the suction grooves.

In a further embodiment of the innovation provision is made for the sealing sheet metal members to be arranged to be capable of displacement in the supporting beam along an axis in parallel with the axis of the fluted roller. In this manner the sealing sheet metal members may follow any thermal expansions of the lower fluted roller and thus may readily follow a displacement of the suction groove.

In the interest of a simple assembly and disassembly of the sealing sheet metal members, provision is made in a further embodiment of the innovation for the sealing sheet metal members to comprise a hook-like upper portion engaging within a complementary portion of the supporting beam, and for one through-going rail or several rail sections to delimit the movement of the sealing sheet metal members in the direction towards the suction grooves, from above. By adjustment of the rail or the rail sections, respectively, the sealing sheet metal members may be readily hung to the supporting beam. The replacement of individual sealing sheet metal members, such members being parts subjected to wear, may, therefore, be accomplished in a very simple manner.

In the following, one example of embodiment of the innovation will be described in more detail by way of a drawing.

The only FIGURE shows in a diagrammatic side view a one-sided corrugated cardboard machine according to the innovation. Prior to enlarging in more detail on the individual represenations shown in the drawing, it is to be stated that each of the parts described are of essential importance to the innovation by themselves or in connection with features of the claims.

The representation in the drawing is extremely schematic and not to scale. The supporting beam and the guiding sheet metal members, in particular, are shown considerably enlarged in comparison with their real dimensions.

In the drawing there are indicated one upper fluted roller 10, one lower fluted roller 11, as well as one pressure roller 12, which are cooperating with each other in a known manner. Arranged on that side of the lower fluted roller 11 which is not in engagement with the corrugated material length 13 is a suction box 14 having a connection 15 for a vacuum. The suction box 14 is adapted to the curvature of the fluted roller 11 on its side facing said roller. The fluted roller 11 is provided with several annular suction grooves 16 at axially spaced intervals. Via said suction grooves 16 the vacuum present in the suction box 14 is transferred to the opposite side, in order to hold the corrugated web against the fluted roller 11.

Extending in parallel with the suction box 14 and approximately over the length of the fluted roller 11 is a supporting beam 17 for sealing sheet metal members 18. Each suction groove 16 has a sealing sheet metal member 18 associated thereto respectively filling the suction grooves 16 with a portion 19. The sealing sheet metal members 18 have a stripper function. They furthermore prevent equalization of the vacuum. But they keep at a distance from the bottom of the grooves to leave a throughgoing channel in the bottom of the suction grooves.

The sealing sheet metal members 18 have an upper hook-like portion 20 cooperating with a hook-like portion 21 at the lower end of the supporting beam 17. It will be noted that the sealing sheet metal members 18 are capable of displacement relative to the supporting beam 17. This displacement enables adaptation to different degrees of thermal expansion of the lower fluted roller 11. Disposed in the cross sectional area 22 of the supporting beam 17 at the upper end thereof are one or several adjusting screws 23 cooperating with a rail 24, said rail constituting an upper limit for the hook-like portion 20 of the sealing sheet metal members 18. In the position as shown in the drawing the sealing sheet metal members 18 are safely accommodated in the supporting beam 17 but may however perform their lateral movement as described.

The suction box 14 is provided with a lateral abutment 25 on the side thereof facing the supporting beam 17 said abutment sealingly cooperating, as shown at 26, with an abutment 27 of the supporting beam 17. On the undersides thereof the hook-like portion 21 and the hook-like portion 27 are respectively adapted to the curvature of the fluted roller 11. As will be noted, care is taken of sufficient sealing.

The suction box 14 is capable of adjustment respectively away from the fluted roller 11 and towards it with the aid of an adjusting means (not shown). A position spaced from the fluted roller 11 is indicated by the broken line 28. The supporting beam 17 is biased in a direction away from the fluted roller 29 by means of a tension spring 29. If, thus, the suction box 14 is adjusted in a sense away from the fluted roller, the supporting beam 17, too, will move away from the fluted roller. This movement, however, continues only as far as an abutment (not shown) which takes care that the sealing sheet metal members 18 do not get out of the suction grooves 16. If the suction box 14 is readjusted, it will take along with it on the end of its way the supporting beam 17 into the position shown in the FIGURE. It goes without saying that also insofar ah abutment may cooperate with the supporting beam 17.

It will be appreciated that by lifting out an easy access is afforded to the fluted roller 11.

I claim:

1. A one-sided corrugated cardboard machine comprising an upper fluted roller and a lower fluted roller, a pressure roller associated with the lower fluted roller, a suction box essentially extending the width of the lower fluted roller and connected to a vacuum source and arranged on that side of the lower fluted roller which is not covered by the corrugated material web and juxtaposed to said upper fluted roller, said suction box creating a vacuum in annular suction grooves of the lower fluted roller, and sealing sheet metal members engaging within the suction grooves on the uncovered side of said lower fluted roller and juxtaposed to said pressure roller, characterized by a supporting beam positioned between said sealing sheet metal members and said suction box and supporting said sheet metal members and said suction box, and said suction box and said sealing sheet metal members being independently adjustable relative to said supporting beam for independent movement of either of said sealing sheet metal members and said suction box relative to said supporting beam.

2. A corrugated cardboard machine according to claim 1, characterized in that for the adjustment of the suction box in the direction towards the lower fluted roller the suction box and the supporting beam comprise cooperating sealing abutments; said supporting beam being biased away from the lower fluted roller; and further comprising another adjustment arranged on the supporting beam and operable to keep the sealing sheet metal members in the suction grooves independent of movement of said suction box.

3. A corrugated cardboard machine according to claim 1, characterized in that the sealing sheet metal members are arranged to be capable of displacement along an axis in parallel with the axis of the lower fluted roller relative to the supporting beam.

4. A corrugated cardboard machine according to claim 2 characterized in that the sealing sheet metal members are arranged to be capable of displacement along an axis in parallel with the axis of the lower fluted roller relative to the supporting beam.

5. A corrugated cardboard machine according to claim 2, characterized in that the sealing sheet metal members have a hook-like upper portion engaging within a complementary portion of the supporting beam, and further comprising means on the supporting beam for limiting the movement of the sealing sheet metal members in the direction out of the suction grooves.

6. A corrugated cardboard machine according to claim 1, wherein the supporting beam has a pair of longitudinally extending grooves each adapted to receive respective flanges formed on the suction box and sealing sheet metal members for retaining the suction box and sheet metal members relative to said supporting beam.

7. A corrugated cardboard machine according to claim 6, wherein the flange and groove of the suction box and supporting beam are in sealing engagement.

8. A corrugated cardboard machine according to claim 6, further including adjustable abutment means carried by the supporting beam and adapted to engage the sealing members for limiting the degree of movement of the sealing members relative to the supporting beam in a direction away from the annular suction grooves.

* * * * *